United States Patent [19]

Tanaka et al.

[11] Patent Number: 4,604,294

[45] Date of Patent: Aug. 5, 1986

[54] PROCESS FOR FORMING AN ORGANIC THIN FILM

[75] Inventors: Masahiro Tanaka, Yokohama; Kazufumi Azuma, Hiratsuka; Kazuo Nate, Machida; Mitsuo Nakatani, Yokohama, all of Japan

[73] Assignee: Hitachi, Ltd., Tokyo, Japan

[21] Appl. No.: 660,230

[22] Filed: Oct. 12, 1984

[30] Foreign Application Priority Data

| | | | |
|---|---|---|---|
| Oct. 14, 1983 | [JP] | Japan | 58-190898 |
| Nov. 30, 1983 | [JP] | Japan | 58-224184 |
| Apr. 16, 1984 | [JP] | Japan | 59-75067 |

[51] Int. Cl.[4] ..... B05D 3/06

[52] U.S. Cl. ..... 427/53.1; 427/255; 427/255.6; 427/294; 427/314

[58] Field of Search ..... 427/53.1, 255, 255.6, 427/294, 314

[56] References Cited

U.S. PATENT DOCUMENTS 3,987,215 10/1976 Cortellino ..... 427/43.1 X 4,390,601 6/1983 Ono et al. ..... 427/255.6 X

FOREIGN PATENT DOCUMENTS 1298453 12/1972 United Kingdom ..... 427/255.6

OTHER PUBLICATIONS

Chemical Abstracts, 94(14): 104,985g (1981).

*Primary Examiner*—Thurman K. Page

*Attorney, Agent, or Firm*—Antonelli, Terry & Wands

[57] ABSTRACT

An organic thin film consisting essentially of an organic compound is formed on a substrate surface by vacuum vapor deposition by exposing the organic compound as a vapor source to a laser beam having an energy level corresponding to that of the chemical bond of the organic compound, thereby sputtering the organic compound onto a substrate surface in vacuum and forming the organic thin film thereon. When a light or radiation-sensitive organic compound is used as the vapor source, a light or radiation-sensitive resist film is formed. The thin film thus formed retains the original chemical structure of the vapor source, and has a good flatness. Resolvability of resist film is improved owing to the absence of pin holes and particulate matters. A resist film having a higher sensitivity and a better contrast is formed by heating the substrate during the vapor deposition.

23 Claims, 8 Drawing Figures

PROCESS FOR FORMING AN ORGANIC THIN FILM

BACKGROUND OF THE INVENTION

This invention relates to a process for forming an organic thin film, and more particularly to a process for forming a light and radiation-sensitive resist film.

Heretofore, a wet process and a dry process are known as the process for forming an organic thin film, among which the wet process has a problem of solvent toxicity or a problem of solvent drying. Organic materials having a low solubility in a solvent or having no appropriate solvent such as polyacetal, etc. cannot be made into a thin film by the wet process. Furthermore, it is very difficult to form a thin film free from pin holes by the wet process.

On the other hand, the dry process so far proposed includes a plasma polymerization process [Japanese Patent Application Kokai (Laid-open) No. 53-12057], a process for sputtering an organic compound [Japanese Patent Applications Kokai (Laid-open) Nos. 58-7703 and 57-116771]. The dry process has an advantage of forming a thinner film with no pin holes, as compared with the wet process. However, in these dry processes, organic compound molecules are considerably damaged by electron impingement. Thus, the formed thin films are in a non-stoichiometric amorphous state, that is, in an amorphous state with indefinite structural units, and can hardly retain the chemical structure of starting material. The sputtering process generally has a disadvantage of low film-forming rate. Furthermore, when polymers are formed on a substrate by sputtering or plasma polymerization of organic compounds, three-dimensionally cross-linked polymers are liable to be formed, so that no intended photosensitivity can be obtained in the application to the resist, etc.

On the other band, a vacuum vapor deposition process using a laser beam is known. For example, a process for vapor depositing an aluminum nitride thin film in vacuum with laser heating [Japanese Patent Application Kokai (Laid-open) No. 51-141800], a process for vapor depositing a boron nitride thin film in vacuum with laser heating [Japanese Patent Application Kokai (Laid-open) No. 54-141799], a process for producing a diamond-form carbon film (Japanese Patent Application Kokai (Laid-open) No. 56-22616), etc. are known. These processes are vacuum vapor deposition processes based on laser heating, using a high power laser of relatively long wavelength such as $CO_2$ laser or YAG laser as a heat source, and have such problems when applied to the formation of an organic thin film as thermal decomposition of organic materials, or only vaporization, resulting in a failure to form an effective thin film, or the film formed being an assembly of low molecules weight modecules with a low mechanical strength.

In the production of semi-conductor devices, a photoetching process is now known as a technique of forming a desired pattern on a semi-conductor substrate. To form a fine pattern on a semi-conductor substrate by the photoetching technique, it is necessary to make a resist film as thin as possible or to increase the resolvability when exposed to light or radiation.

It has been so far tried to produce the semi-conductor devices not by a wet process, but entirely by a dry process, but two steps, that is, the resist film-forming step and the development step, must have been carried out by a wet process. That is, in the resist film-forming step, said plasma polymerization process, a gaseous phase photopolymerization process [Japanese Patent Application Kokai (Laid-open) No. 53-120529], or said vacuum vapor deposition process with laser heating has been proposed as the dry process. The plasma polymerization process can form a thin, uniform organic film free from pin holes, but the organic thin film is liable to undergo three-dimensional cross-linking when polymerized under plasma irradiation, or to have an irregular chemical structure, or their functional groups sensitive to light or radiation are liable to be damaged. Thus, it is very difficult to form a resist film sensitive to light or radiation by the plasma polymerization process. The gaseous phase photopolymerization process can form a resist film capable of forming a fine pattern without any considerable damage to the chemical structure, but has a very slow film-forming rate, and thus is not much practical. The vacuum vapor deposition process with laser heating so far proposed uses a high power laser of relatively long wavelength as a heat source and has the problems as mentioned above, with a failure to produce an effective resist film.

On the other hand, in the step of forming a light or radiation-sensitive resist film by the wet process so far known, many pin holes are formed, if the thickness of the film is made smaller, as mentioned above, and it is difficult to uniformly form a satisfactorily thin resist film free from the pin holes, and thus the resolvability cannot be improved satisfactorily.

Resist materials having a very high sensitivity to X rays or electron beam and an excellent resolvability have been now developed for the wet process, but a large number of such resist materials cannot be duly evaluated owing to poor solubilities in solvents, though they have expectable distinguished resist characteristics.

Furthermore, the formation of a resist film by the wet process has said hard-to-solve problems, such as solvent toxicity, solvent drying, etc.

SUMMARY OF THE INVENTION

An object of the present invention is to provide a process for forming an organic thin film at a high film-forming rate by a dry process, where the chemical structure of a raw material can be retained in the organic thin film.

Another object of the present invention is to provide a process for forming an organic thin film by a dry process, where the organic thin film can be formed without thermal decomposition and deterioration of the mechanical strength.

Further object of the present invention is to provide a process for forming an organic thin film by a dry process without formation of three-dimensionally cross-linked polymers.

Still further object of the present invention is to provide a process for forming a resist film of an organic compound sensitive to light or radiation suitable for forming a fine pattern by a dry process.

Still further object of the present invention is to provide a process for forming a resist film sensitive to light or radiation, suitable for forming a fine pattern where the resist film has a narrow molecular weight distribution, a low content of low molecular weight components, a good sensitivity to light or radiation, a small film thickness and a high contrast.

According to the present invention, an organic thin film is formed by vacuum vapor deposition, where a laser beam having an energy level corresponding to that of the chemical bond of an organic compound as a vapor source is irradiated to said organic compound, whereby said organic compound is sputtered onto the surface of a substrate to form an organic thin film made substantially from said organic compound.

According to the present invention, an organic thin film retaining the chemical structure of an organic compound as a vapor source, that is, a target, can be formed at a high film-forming rate without formation of three-dimensionally cross-linked polymers. An organic compound as a vapor source is irradiated with light or radiation rays of an energy level corresponding to that of a specific chemical bond of the organic compound to photochemically break the chemical bond and vaporize the organic compound as chemically active low molecules, and the vaporized molecules are sputtered onto the surface of a substrate and polymerized thereon to form a strong organic thin film. That is, the organic compound is vapor deposited in vacuum in the present invention.

Laser used as the light or irradiation source in the present invention can improve the selectivity to photolytic reaction by selecting its wavelength on account of its monochromatic property, so that the chemical structure of the resulting organic thin film can be well controlled. Particularly by using a laser of short wavelength corresponding to the ultraviolet absorption of an organic compound as a vapor source, the desired site of the organic compound can be photolyzed with a high efficiency to make the organic compound into low molecular weight components and vaporize it.

Preferable wavelength of laser beam for use in the present invention is 190 to 400 nm. Above 400 nm, the heat effect is more considerable than the light effect during the decomposition of an organic compound as a vapor source, and an organic thin film having a stoichiometric composition is hard to obtain. Below 190 nm, on the other hand, absorption by air becomes large, and thus all the beam paths must be kept in vacuum. The light or irradiation below 190 nm has a high energy level and cannot improve the selectivity to the photolytic reaction.

The organic compound for use in the present invention as a vapor source or target merely for forming an organic thin film is polymers having readily light-decomposable chemical bonds in the main chain, and polymers producing low molecular weight components of particularly high stability by the photolytic reaction are not suitable.

Particularly in the formation of light or radiation-sensitive resist films, polymers having light or radiation-sensitive functional groups are suitable as the organic compounds as the target, and include, for example, polymethacrylic acid esters such as polymethylmethacrylate, polyethylmethacrylate, polybutylmethacrylate, polyphenylmethacrylate, polyglycidylmethacrylate, etc., and copolymers containing at least one of said polymethacrylic acid esters; ketonic polymers such as polymethylisopropenyl ketone, polyphenylisopropenyl ketone, etc. and copolymers containing at least one of the ketonic polymers; other polymeric compounds such as polybutene-1 sulfone, polyacrylic acid esters, polyacrylic acid, etc. Particularly for the positive-type resist, polymethylmethacrylate and polymethylisopropenyl ketone are preferable in view of the film formatility and sensitivity, and for the negative-type resist, polyglycidylmethacrylate, its copolymers with polyethylacrylate, and polydichloropropylacrylate are preferable.

A laser beam source for use in the present invention includes, for example, second harmonic wave of argon ion laser, excited dimer lasers of $F_2$, ArF, KrF, XeCl, $N_2$, etc. Oscillation can be continuous or by pulse.

The necessary laser power is more than the threshold power dependent on an organic compound as the target, and when the laser power is short, the laser beam must be concentrated by a lens, a concave mirror, etc. to increase the intensity of light per unit area. Even if the laser power is short, the heat by the energy of the laser beam is accumulated on the target, and the organic compound can be decomposed by the heat effect, but the efficiency of vapor deposition is not better and the molecular weight of the organic film is smaller in that case.

Laser power density depends on the species of organic compounds as the target, and is preferably in a range of 0.5–30 J/cm$^2$. Below 0.5 J/cm$^2$, the film-forming rate becomes very low, whereas above 30 J/cm$^2$, there is a possibility of damaging the functional groups by exposure to laser beam. For the polymethylmethacrylate and the ketonic polymers, as laser power density of 10 to 20 J/cm$^2$ is preferable in view of the film-forming rate and retaining of the functional groups.

In the present invention, an optical system such as a lens, a mirror, etc. can be used, if necessary, to guide the laser beam to the target. A mirror capable of efficiently reflecting the laser beam is preferable, and any lens can be used, so long as it is transparent to the laser beam.

Higher vacuumness at the vapor deposition is preferable, and a preferable range of vacuumness is $10^{-8}$ to $10^{-2}$ Torr. Above $10^{-8}$ Torr, the apparatus cost is increased, whereas, below $10^{-2}$ Torr, the mean free path becomes short, and vapors of an organic compound on the way from the target to the substrate undergo gaseous phase growth, and the organic compound are formed in a particulate form on the substrate surface, considerably deteriorating the flatness of the organic thin film. In other words, the flatness of the film can be considerably improved under such a vacuumness as to make the mean free path larger than the distance from the target to the substrate.

It is preferable to disperse as much as possible the heat generated when the target as a vapor source is exposed to a laser beam to prevent any chemical or physical change due to the heat on the target. For this purpose, a laser beam can be scanned on the target, or the target can be revolved or moved.

Generally, the sensitivity of light or radiation-sensitive resist film greatly depends upon the molecular weight. It is known that the resist film with a higher molecular weight is more sensitive, and it is also known that higher contrast of light or radiation-sensitive resist film can be obtained with a narrower molecular weight distribution.

In the present invention, a more improved resist film having a narrower molecular weight distribution and a smaller content of low molecular weight components can be formed by heating the substrate to a little higher temperature during the laser beam vapor deposition. That is, the low molecular weight components having high vapor pressures can be prevented from condensation on the substrate surface by heating the substrate to a little higher temperature during the vapor deposition, whereby a light or radiation-sensitive resist film having a narrow molecular weight distribution and a small content of low molecular weight components can be formed.

The substrate can be heated in the ordinary manner, and particularly irradiation of the substrate from the back side with an infrared lamp or a halogen lamp is an efficient means because of vapor deposition in vacuum, or the substrate can be heated simply by providing the substrate on a support base embedded with a heater.

Substrate temperature control is particularly important. At too high a temperature, the film-forming rate is considerably lower, or sometimes thermal decomposition of the organic compound as the target so proceeds that carbides may be deposited onto the substrate, whereas at too low a temperature the low molecular weight components cannot be eliminated. Thus, it is desirable to use a temperature by at least 10° C. lower than the decomposition point of an organic compound as the target but so high as to effectively eliminate the low molecular weight components, that is, higher than the boiling point of monomeric components under the vacuumness at the vapor deposition. The temperature control must be carried out as exactly as possible, and desirably by automatic control. Substrate temperature can be measured by a thermocouple, a thermistor owing to a relatively low temperature, or a temperature-sensitive paint, etc., and particularly a thermocouple or thermistor is convenient for the automatic control.

An energy source for use in the pattern formation on a resist film in the present invention includes, for example, an ultraviolet lamp such as a low pressure mercury lamp, a high pressure mercury lamp, a xenon mercury lamp, etc.; electron beams, soft X rays, etc. They are selected in view of the desired fineness of a pattern.

The pattern can be developed by a wet process using a solvent such as acetone [$(CH_3)_2$ CO], MEK[methylethyl ketone $$(CH_3)\underset{\underset{O}{\|}}{C}(C_2H_5),$$

alcohols ($CH_3OH$, $C_2H_5OH$, $C_3H_7OH$, etc.) on the basis of a difference in solubility of the light-exposed parts, or by a dry process by scattering the light-exposed parts by heat.

DESCRIPTION OF THE PREFERRED EMBODIMENTS

The present invention will be described in detail below, referring to Examples and the accompanying drawings.

Figure 1:
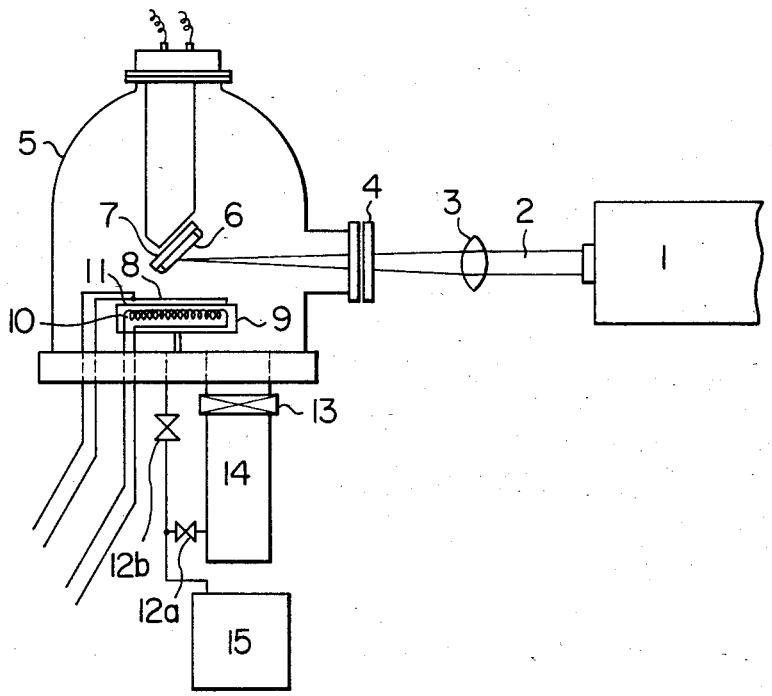
FIG. 1 is a schematic view showing one embodiment of a laser vapor-deposition apparatus for carrying out the present invention.

The laser vapor-deposition apparatus shown in FIG. 1 has the following structure. Laser beam 2 emitted from laser oscillator 1 is concentrated by lens 3 of synthetic quartz and introduced into vacuum chamber 5 through window 4 of synthetic quartz. Laser beam 2 introduced into vacuum chamber 5 hits target 6 supported on a revolving target base 7 to vaporize target 6. Target vapors are deposited on substrate 8 placed on a substrate base 9 embedded with heater 10. To measure the substrate temperature during the vapor deposition, thermocouple 11 is provided on the substrate surface. The laser vapor-deposition apparatus is provided with diffusion pump 14 and rotary pump 15 to keep vacuum chamber 5 in a highly vacuum state by switching valves 12*a* and 12*b* and gate valve 13. To prevent laser beam 2 from focussing at one point on target 6, rotatary base 7 for the target 6 can be rotated during the vapor deposition.

Examples of actually forming an organic film in the laser vapor-deposition apparatus shown in FIG. 1 will be described below.

EXAMPLE 1

A polyacetal thin film having a film thickness of about 3,000 Å was formed on a silicon wafer as substrate 8 at vacuumness of $2\times10^{-6}$ to $5\times10^{-8}$ Torr in vacuum chamber 5 in the apparatus of FIG. 1, using KrF excited dimer laser beam (500 mJ/pulse, wavelength: 248 nm) from laser oscillator 1 and a polyacetal plate as target 6. The thus formed film had a uniformly flat surface free from particulate matters and pin holes. The film-forming rate was 5 Å per pulse, and the film-forming rate per unit time is proportional to the pulse frequency.

Figure 2A:
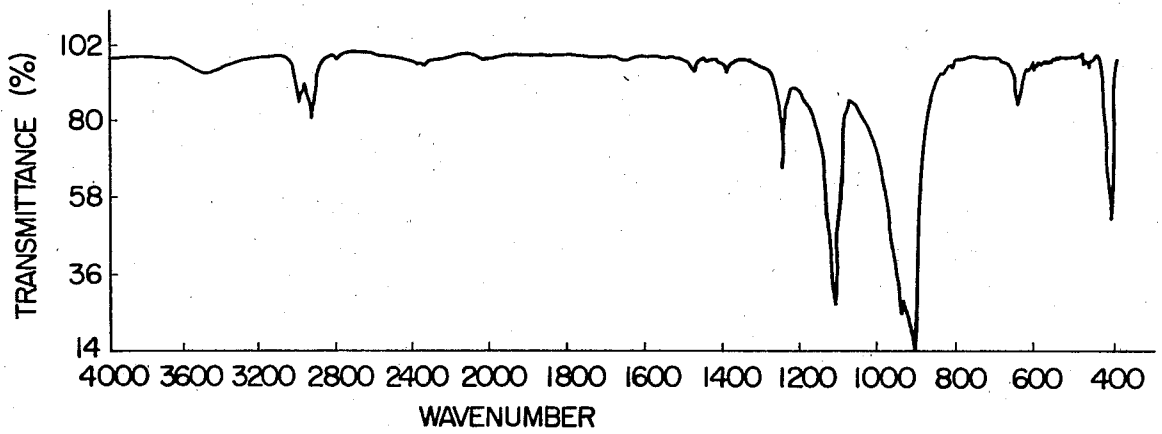
FIGS. 2(A) and (B) are infrared absorption spectrum diagrams of polyacetal film formed according to one embodiment of the present invention and raw material polyacetal as a target, respectively.
Figure 2B:
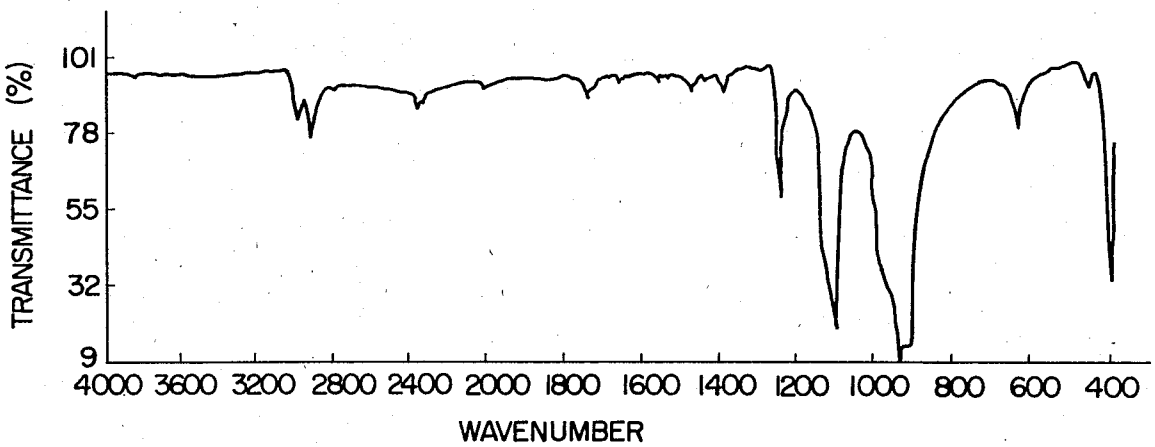

The infrared absorption spectra of the polyacetal thin film thus formed and the starting material polyacetal, measured by tablet method, are shown in FIG. 2(A) and 2(B), respectively. These two spectra are in good agreement with each other, and thus it is seen that the film formed in this Example has the same chemical structure as the starting material.

The polyacetal film formed in this Example and the starting material polyacetal were subjected to thermal analysis using a differential thermal balance. It was found that heat absorption occurred at 150° C. and complete decomposition and vaporization occurred till 350° C., and thus it can be seen that no reaction to form a decomposition-inhibiting chemical structure such as cross-linking reaction, etc. will occur during the vapor deposition.

On the other hand, it was found that the polyacetal film formed in this Example was insoluble in organic solvents and thus retained the property of polyacetal even as to the solubility, and also had a sufficiently large molecular weight.

As shown above, it was possible in this Example to make organic materials having no appropriate solvents such as polyacetal into a uniformly flat thin film, while retaining its original chemical structure and properties.

EXAMPLE 2

Thin films were formed from polymethylmethacrylate (PMMA) powder (molecular weight: about $7\times10^5$) as target 6 in the same manner as in Example 1, while keeping substrate 8 at 20° C. without heating heater 10 and scanning the laser beam without rotating rotary base 7 for target 6. Films free from particulate matters and pin holes were obtained in vacuum of $10^{-3}$ Torr or less.

Figure 3:
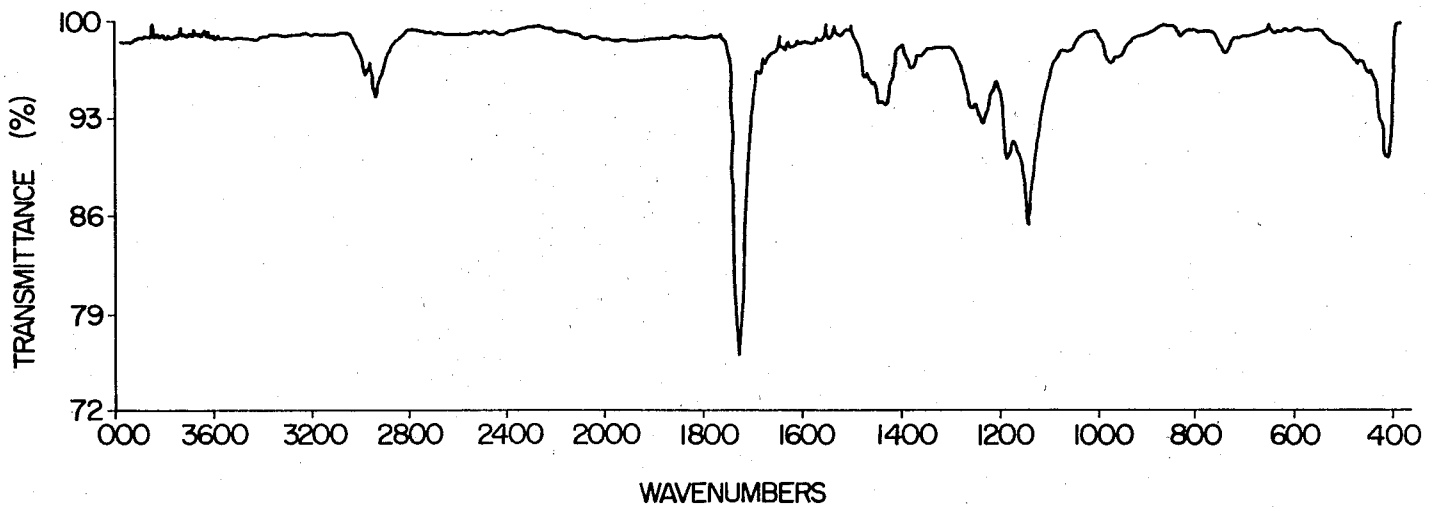
FIG. 3 is an infrared absorption spectrum diagram of polymethylmethacrylate (PMMA) formed according to one embodiment of the present invention.
Figure 4:
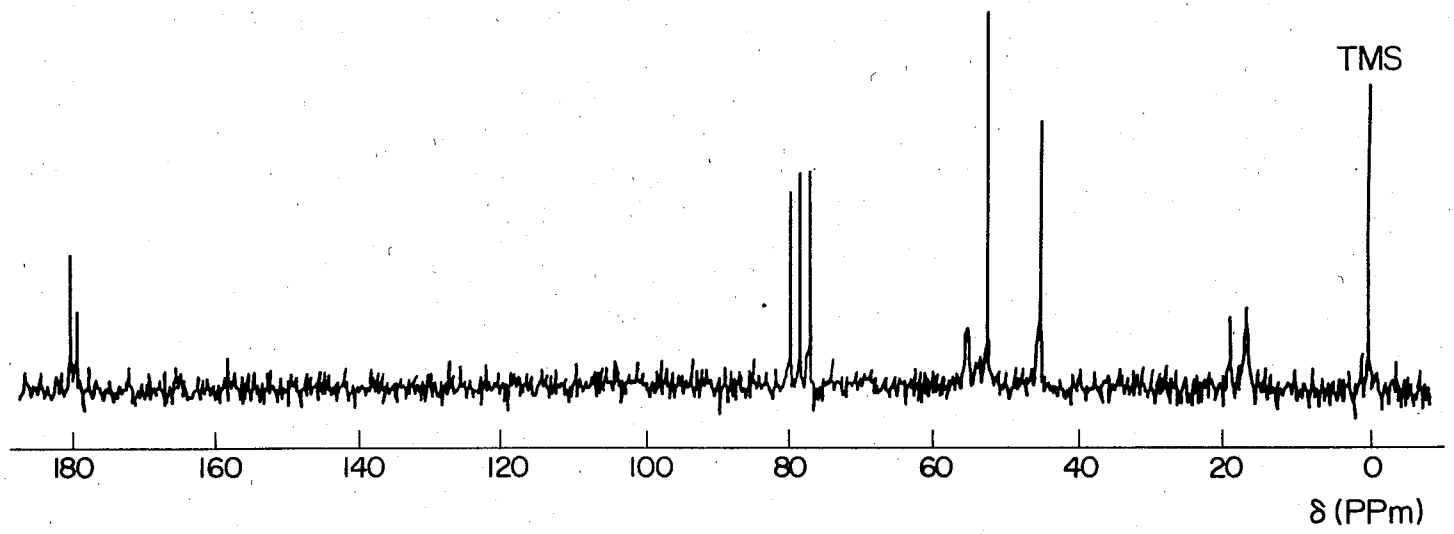
FIG. 4 is a $^{13}C$ nuclear magnetic resonance (NMR) spectrum diagram of the same PMMA film as used in FIG. 3.
Figure 5:
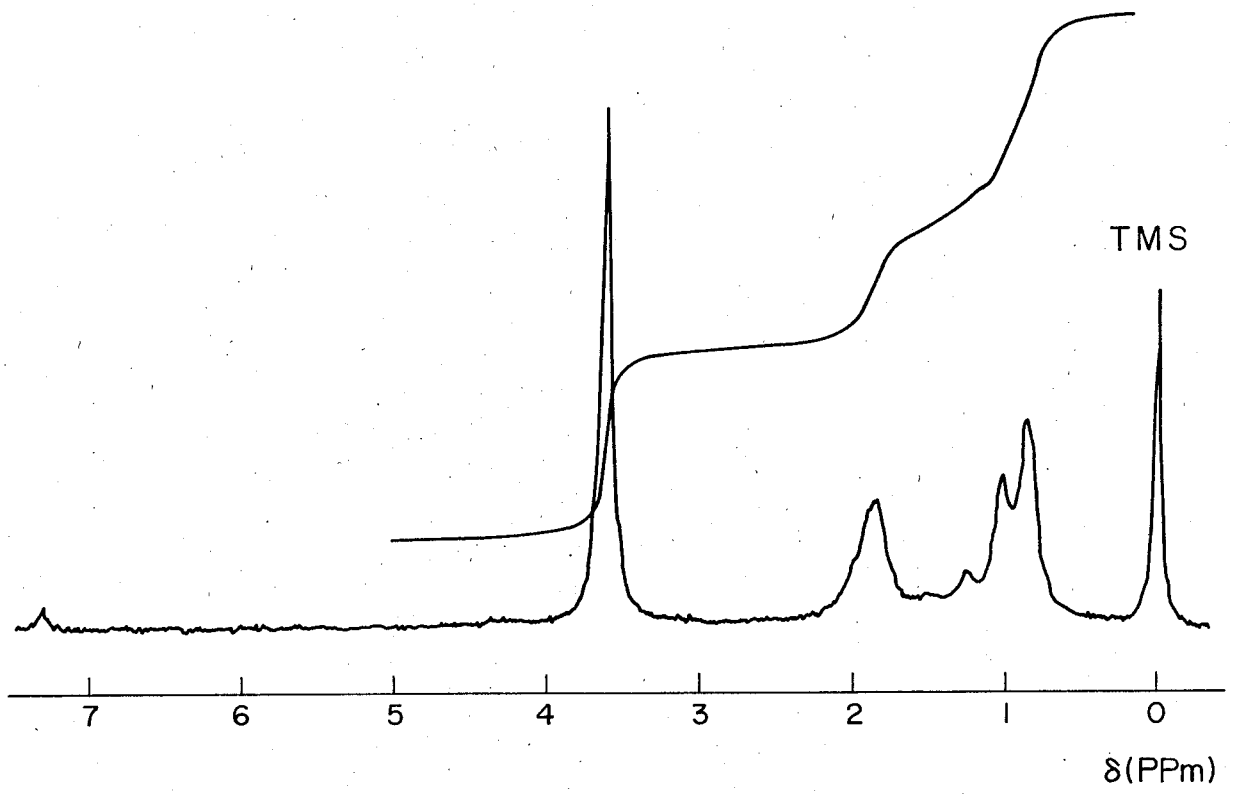
FIG. 5 is a $^{1}H$ nuclear magnetic resonance (NMR) spectrum diagram of the same PMMA film as used in FIG. 3, using $COCl_3$ as a solvent.

In FIG. 3, the infrared absorption spectrum of the PMMA film formed in this Example is shown. In FIG. 4, $^{13}C$ nuclear magnetic resonance (NMR) of the same PMMA film is shown. In FIG. 5, $^{1}H$ NMR spectrum of the same PMMA film is shown. It is seen from these diagrams that the PMMA films formed in the present invention completely retain all the absorptions attributable to C—O, C=O, C—H, etc. of the target PMMA, and thus completely retain the original chemical structure of the target PMMA without any chemical change to the functional groups.

The thus formed PMMA films were soluble in toluene and chloroform, and thus it was found that no insolubilization reactions such as cross-linking, etc. took place.

Figure 6:
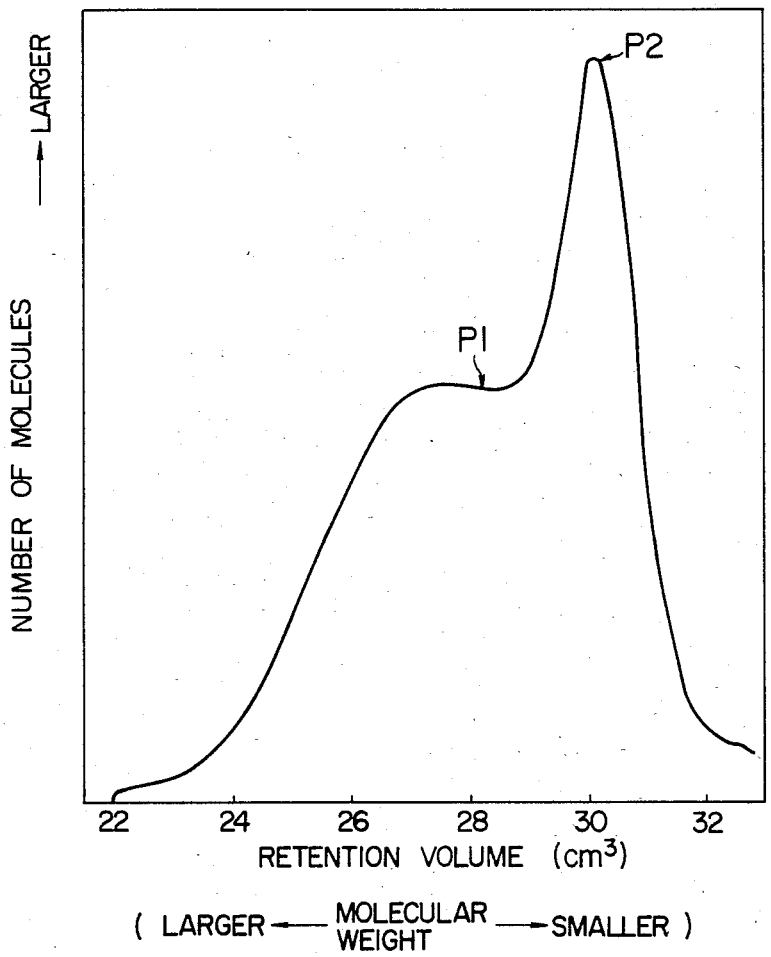
FIG. 6 shows one example of molecular weight distribution of a film formed by keeping a substrate at room temperature (20° C.) without heating.

The thus formed PMMA film was dissolved in chloroform, and the molecular weight distribution of the thus formed PMMA film was measured by gel permeation chromatography, and the results are shown in FIG. 6, where the flow volume (integrated volume) of the solvent leaving the high speed liquid chromatographic apparatus whose column is filled with gel to conduct gel permeation chromatography is shown as a retention volume on the abscissa and the number of molecules measured by ultraviolet absorption spectrometry when the solution leaves the high speed liquid chromatographic apparatus is shown on the ordinate. In the gel permeation chromatography, lower molecular weight components are trapped by the gel and are hard to pass through the column. Thus, higher molecular weight components flow at first from the column, and then lower molecular weight components gradually flow from the column. That is, the molecular weight changes from the larger to the lower with changes of the retention volume from the smaller value to the larger. As is obvious from FIG. 6, there are two peaks P1 and P2 in the number of molecule in the higher molecular weight region and the lower molecular weight region, respectively, and thus a large number of low molecular weight components are contained.

Photo-sensitivity and electron beam sensitivity of the thus formed PMMA films were investigated in the following manner. The PMMA films formed on the silicon wafer substrate to a film thickness of about 3,000 Å were exposed to ultraviolet rays from a 500 W xenon-mercury lamp at various irradiation dosages, and it was found that the parts exposed at the irradiation dosage of 1.0 J/cm$^2$ completely turned into positive-type resists soluble in a developing solution (a liquid mixture of methylisobutyl ketone and isopropyl alcohol in a ratio of the former to the latter of 1:3 by volume).

Then, the PMMA films formed in the same manner as above were exposed to electron beams of 20 KeV in vacuum, and it was found that the exposed parts turned into positive-type resists soluble in said developing solution.

The electron beam sensitivity in terms of minimum irradiation dossage to make the film thickness zero by the development was $5\times10^{-5}$ C/cm$^2$. The resolvability by electron beam irradiation was evaluated. It was found that line and spaces at 1 μm could be resolved and the resolvability was suitable for forming a fine pattern.

The PMMA films formed with a pulse power of 800 mJ while rotating both target and substrate had the results similar to the above.

PMMA films were formed in the same manner as above, except that the substrate was heated to 80° C. by passing an electric current through heater 10.

The photosensitivity and electron beam sensitivity of the PMMA films formed to a film thickness of about 3,000 Å while heating the substrate at 80° C. were investigated in the same manner as above. The PMMA films were exposed to ultraviolet rays from said 500 W xenon-mercury lamp or a 500 W helium-mercury lamp at various irradiation dosages, and it was found that the exposed parts turned into positive type resists soluble in said developing solution. The photosensitivity in terms of minimum light irradiation dosage to make the film thickness zero by the development was 0.3 J/cm$^2$.

The similarly formed PMMA films were exposed to electron beams of 20 KeV in vacuum and it was found that the exposed parts turned into positive-type resists soluble in said developing solution, as in the case of ultraviolet irradiation. The electron beam sensitivity in terms of the minimum electron beam dosage was $1\times10^{-5}$ C/cm$^2$, and the resolvability by electron beam irradiation was such that lines and spaces at 1 μm could be resolved, and was suitable for forming a fine pattern.

The PMMA film formed while heating the substrate had an improved electron beam sensitivity.

Figure 7:
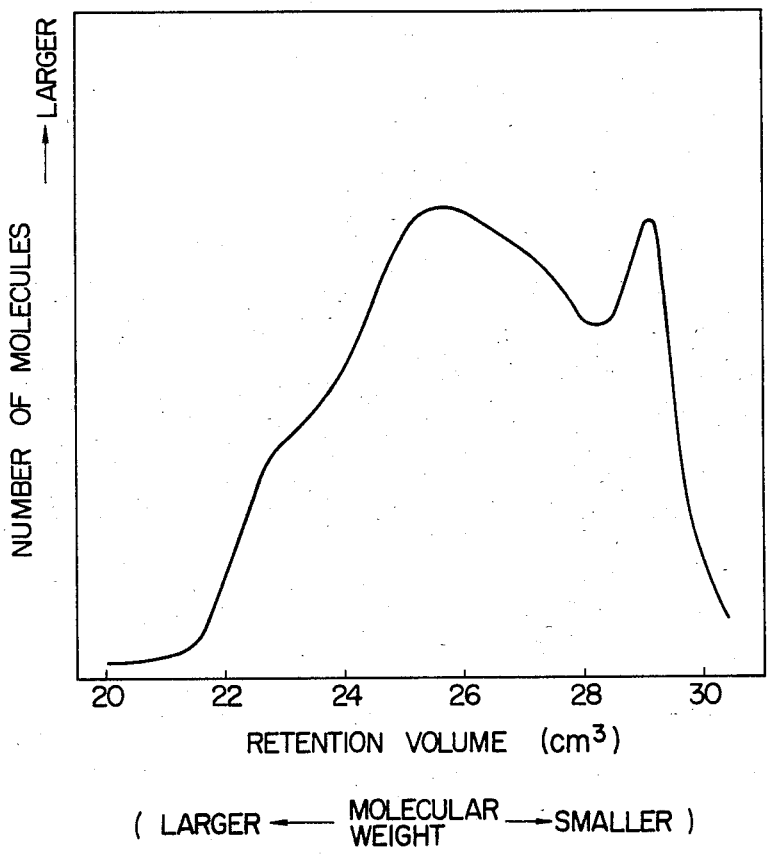
FIG. 7 shows one example of molecular weight distribution of a film formed by heating the substrate at 80° C.

The PMMA film formed while heating the substrate was dissolved in chloroform, and the molecular weight distribution of the PMMA film was measured by gel permeation chromatography. The results are shown in FIG. 7. As is obvious from comparison with FIG. 6 showing the molecular weight distribution of the PMMA film formed while keeping the substrate at 20° C., the content of the lower molecular weight components is considerably decreased, and the molecular weight distribution is narrowed by heating the substrate.

EXAMPLES 3 TO 12

Various films were formed in the same manner as in Example under the conditions shown in the following Table. It is seen from Table that good results could be obtained.

TABLE

| Ex. No. | Laser | Wave-length (nm) | Laser power (mJ/pulse) | Target | Vacuum-ness (Torr) | Retained original chemical structure | Film forming rate (Å/pulse) | Flat-ness |
|---|---|---|---|---|---|---|---|---|
| 3 | Excited dimer laser ArF | 193 | 500 | PMMA | $10^{-3}$ | good | 10 | good |
| 4 | Excited dimer laser ArF | " | " | Polyacetal | $10^{-3}$ | " | 8 | " |
| 5 | Excited dimer | " | " | Poly-p-methylstyrene | $10^{-4}$ | " | 11 | " |

TABLE-continued

| Ex. No. | Laser | Wave-length (nm) | Laser power (mJ/pulse) | Target | Vacuum-ness (Torr) | Retained original chemical structure | Film forming rate (Å/pulse) | Flat-ness |
|---|---|---|---|---|---|---|---|---|
| | laser ArF | | | | | | | |
| 6 | Excited dimer laser XeCl | 308 | 500 | PMMA | $10^{-4}$ | " | 6 | " |
| 7 | Excited dimer laser XeCl | " | " | Polyacetal | $10^{-4}$ | " | 5 | " |
| 8 | Excited dimer laser XeCl | " | " | Poly-p-methylstyrene | $10^{-4}$ | " | 8 | " |
| 9 | Excited dimer laser KrF | 249 | 1000 | Poly-p-methylstyrene | $10^{-4}$ | " | 6 | " |
| 10 | $N_2$ laser | 337 | 16 | PMMA | $10^{-4}$ | " | 1 | " |
| 11 | $N_2$ laser | 337 | 16 | Polyacetal | $10^{-4}$ | " | 1 | " |
| 12 | $N_2$ laser | " | " | Poly-p-methylstyrene | $10^{-4}$ | " | 1 | " |

EXAMPLE 14

Polybutylmethacrylate films were formed from polybutylmethacrylate target with irradiation of excited dimer laser of XeF (wavelength: 351 nm; pulse power: 400 mW) without heating the substrate by a heater, i.e. while keeping the substrate at 20° C. in the same manner as in Example 1 in the same apparatus as shown in FIG. 1.

The polybutylmethacrylate films formed on the silicon wafers to a film thickness of about 3,000 Å were exposed to electron beams of 20 KeV in vacuum, and it was found that the exposed parts turned into positive-type resists soluble in the developing solution of Example 2. The electron beam sensitivity in terms of the minimum irradiation dosage was $6\times10^{-5}$ C/cm$^2$, and the resolvability by electron beam irradiation was such that line and spaces at 1.2 μm could be resolved.

The polybutylmethacrylate films formed while heating the substrate at 90° C. by passing an electric current through heater 10 to the same film thickness of about 3,000 Å turned into positive-type resists where the parts exposed to the electron beams of 20 KeV were soluble in said developing solution. The electron beam sensitivity of the films in terms of the minimum irradiation dosage was $1\times10^{-5}$ C/cm$^2$, and the resolvability by electron beam irradiation was such that lines and spaces at 1.2 μm could be resolved.

The electron beam sensitivity could be improved by heating the substrate.

EXAMPLE 15

Polymethylisopropenyl ketone (PMIPK) films were formed from PMIPK as a target with irradiation of excited dimer laser of KrF (wavelength: 248 nm, pulse power: 800 mW) at a vacuumness of about $10^{-6}$ Torr while keeping the substrate at 20° C. without heating the heater in the same manner as in Example 1 in the same apparatus as shown in FIG. 1.

The PMIPK films formed on the silicon wafers to a film thickness of about 3,000 Å turned into positive-type resists by irradiation of electron beams of 20 KeV in vacuum, where the exposed parts were soluble in the developing solution of Example 2. The electron beam sensitivity in terms of the minimum irradiation dosage was $3\times10^{-5}$ C/cm$^2$, and the resolvability by electron beam irradiation was such that lines and spaces at 1.0 μm could be resolved.

The PMIPK films similarly formed while heating the substrate to 75° C. by passing an electric current through heater 10 turned into positive-type resists by irradiation of electron beams of 20 KeV in vacuum, where the exposed parts were soluble in said developing solution. The electron beam sensitivity in term of the minimum irradiation dosage was $9\times10^{-6}$ C/cm$^2$ and the resolvability by electron beam irradiation was such that lines and spaces at 1.0 μm could be resolved.

The electron beam sensitivity could be improved by heating the substrate.

EXAMPLE 16

Films of polyglycidylmethacrylate-polyethylacrylate copolymer (PGMA+PEA) were formed from PGMA-PEA as a target with irradiation of excited dimer laser of KrF (wavelength: 248 nm, pulse power: 800 mW in vacuumness of about $10^{-6}$ Torr while keeping the substrate at 77° C. by passing an electric current through heater 10 in the same manner as in Example 1 in the same apparatus as shown in FIG. 1.

The PGMA-PEA films formed on the silicone wafers to a film thickness of about 3,000 Å turned into negative-type resists by irradiation of electron beams of 20 KeV in vacuum, where the exposed parts were insoluble in a solvent mixture of methylethyl ketone and ethyl alcohol in a ratio of 1:1 by volume. The electron beam sensitivity in terms of an irradiation dosage that the remaining film is reduced to 50% after the development, that is, different definition from that used in Examples 2, and 13 to 15, was $2\times10^{-6}$ C/cm$^2$, and the resolvability by electron beam irradiation was such that line and spaces at 1.0 μm could be resolved.

The PGMA-PEA films similarly formed while keeping the substrate at 20° C. without heating the heater had an electron sensitivity of $2\times10^{-5}$ C/cm$^2$ in terms of the irradiation dosage that the remaining film is reduced to 50% after the development.

It is seen from the foregoing that the electron sensitivity in terms of the irradiation dosage that the remaining film is reduced to 50% after the development could be improved by heating the substrate.

As described above, an organic film retaining the same chemical structure as the starting material can be formed at a high film-forming rate by a dry process in the present invention without producing three-dimensionally cross-linked polymers, and also a light or radiation-sensitive organic film suitable for forming a fine pattern can be formed by a dry process even from starting polymeric materials which have been hard to use owing to the insolubility. The films thus formed are small in film thickness, uniform in flatness, and free from particulate matters and pin holes, and thus are effective for improving the resolvability as a resist. Furthermore, a resist film with a smaller content of lower molecular weight components, a narrower molecular weight distribution and a higher sensitivity to light or radiation, that is, a higher sensitivity with a higher contrast, can be formed with a remarkable effect on formation of finer pattern.

The present invention can be useful for forming insulating films for semi-conductor devices, passivation films, protective films for magnetic discs, etc, resist films of dry process lithography, etc. owing to said distinguished characteristics.

What is claimed is:

1. A process for forming an organic thin film on a substrate by vacuum vapor deposition, which comprises exposing an organic compound as a vapor source to a laser beam having an energy level corresponding to that of the chemical bond of the organic compound in vacuum, to break the chemical bond and form vapors from said organic compound, and sputtering the organic compound vapors in vacuum onto a substrate surface and forming a film consisting essentially of the organic compound thereon.

2. A process according to claim 1, where the laser beam has a wavelength of 190 to 400 nm.

3. A process according to claim 1, wherein the sputtering is carried out in a degree of vaccum of $10^{-8}$ to $10^{-2}$ Torr.

4. A process according to claim 1, wherein the laser beam has a power density of 0.5 to 30 J/cm$^2$.

5. A process according to claim 1, wherein the substrate is heated.

6. A process for forming a light or radiation-sensitive resist film by vacuum vapor deposition on a substrate, which comprises exposing a light or radiation-sensitive organic compound as a vapor source to a laser beam having an energy level corresponding to that of the chemical bond of the organic compound in vacuum, to break the chemical bond and form vapors from said organic compound, and sputtering the organic compound vapors in vacuum to a substrate surface and forming a resist film consisting essentially of the organic compound thereon.

7. A process according to claim 6, wherein the laser beam has a wavelength of 190 to 400 nm.

8. A process according to claim 6, wherein the sputtering is carried out in a degree of vacuum of $10^{-8}$ to $10^{-2}$ Torr.

9. A process according to claim 6, wherein the laser beam has a powder density of 0.5 to 30 J/cm$^2$.

10. A process according to claim 6, wherein the organic compound as the vapor source is at least one of polymethacrylate esters and ketonic polymers.

11. A process according to claim 6, wherein the substrate is heated.

12. A process according to claim 1, wherein said organic compound is a polymer.

13. A process according to claim 1, wherein the laser beam has an energy level corresponding to that of the chemical bond so as to photochemically break the chemical bond and form the organic compound vapors, and wherein in forming said film the vapors are polymerized on the substrate.

14. A process according to claim 13, wherein said organic compound is a polymer.

15. A process according to claim 1, wherein said organic compound is selected from the group consisting of polymethacrylic acid esters and copolymers thereof, ketonic polymers and copolymers thereof, polyacrylic acid esters, polyacrylic acid and polybutene-1-sulfone.

16. A process according to claim 1, wherein the organic compound is spaced a predetermined distance from said substrate, and the sputtering is carried out under a sufficient vacuum such that the mean free path of the organic compound vapors is larger than said predetermined distance.

17. A process according to claim 5, wherein the substrate is heated to a temperature at least 10° C. lower than the decomposition temperature of the organic compound but higher than the boiling point of the components of the organic compound vapors.

18. A process according to claim 1, wherein said organic compound is in solid form.

19. A process according to claim 10, wherein the laser beam has a power density of 10 to 20 J/cm$^2$.

20. A process according to claim 6, wherein the laser beam has an energy level corresponding to that of the chemical bond so as to photochemically break the chemical bond and form the organic compound vapors, and wherein in forming said film the vapors are polymerized on the substrate.

21. A process according to claim 20, wherein said organic compound is a polymer.

22. A process according to claim 6, wherein the organic compound is spaced a predetermined distance from said substrate, and the sputtering is carried out under a sufficient vacuum such that the means free path of the organic compound vapors is larger than said predetermined distance.

23. A process according to claim 11, wherein the substrate is heated to a temperature at least 10° C. lower than the decomposition temperature of the organic compound but higher than the boiling point of the components of the organic compound vapors.

* * * * *